US005316577A

United States Patent [19]

Wu

[11] Patent Number: 5,316,577

[45] Date of Patent: May 31, 1994

[54] PLASTICALLY DEFORMABLE METALLIC MIXTURES AND THEIR USE

[75] Inventor: Shy-Hsien Wu, Horseheads, N.Y.

[73] Assignee: Corning Incorporated, Corning, N.Y.

[21] Appl. No.: 829,306

[22] Filed: Feb. 3, 1992

[51] Int. Cl.[5] ..... B01J 13/00; C08L 1/26

[52] U.S. Cl. ..... 106/197.1; 106/162; 106/181; 106/188; 252/315.3; 264/177.12

[58] Field of Search ..... 252/309, 315.3, 313.1, 252/512, 513; 106/1.05, 197.1, 1.22, 162, 181, 188

[56] References Cited

U.S. PATENT DOCUMENTS

| | | | |
|---|---|---|---|
| 2,124,331 | 7/1938 | Bookmühl et al. | 252/315.3 |
| 2,259,457 | 10/1941 | Croll | 252/303 |
| 3,668,288 | 6/1972 | Takahashi | 264/47 |
| 3,790,654 | 2/1974 | Bagley | 264/177 |
| 4,162,285 | 7/1979 | Tanabashi | 264/66 |
| 4,376,654 | 3/1983 | Zola | 106/197.2 X |
| 4,519,844 | 5/1985 | Chaux et al. | 252/315.3 X |
| 4,551,295 | 11/1985 | Gardner et al. | 264/177 |
| 4,725,317 | 2/1988 | Wheeler | 252/315.2 X |
| 4,816,182 | 3/1989 | Novich et al. | 252/313.1 |
| 4,902,216 | 2/1990 | Cunningham et al. | 425/463 |
| 4,965,039 | 10/1990 | Schuetz | 264/553 |
| 4,992,233 | 2/1991 | Swaroop et al. | 419/2 |
| 4,996,015 | 2/1991 | Yoshimoto et al. | 264/177.11 |
| 5,045,236 | 9/1991 | Tsunaga et al. | 252/512 |
| 5,206,021 | 4/1993 | Dookhith et al. | 252/313.1 X |

*Primary Examiner*—Richard D. Lovering
*Attorney, Agent, or Firm*—Angela N. Nwaneri

[57] ABSTRACT

A plastically deformable metallic mixture is provided using finely divided metallic particulate matter, organic binding agent, polar liquid, anionic dispersing agent and nonionic surfactant. The invention is also directed at a mixture further comprising water-miscible organic solvent. The mixture of this invention is generally stable, froth-free, homogeneous and uniformly dispersed. A process is described by which the mixtures can be formed into useful articles and structures having superior skin qualities.

27 Claims, No Drawings

PLASTICALLY DEFORMABLE METALLIC MIXTURES AND THEIR USE

BACKGROUND OF THE INVENTION

This invention relates to plastically deformable mixtures based primarily on well dispersed sinterable metallic particles, organic binding agent, and polar liquid. The invention provides homogeneous mixtures and processes for forming or shaping them into useful articles or structures. Particularly useful shapes formed by the practice of this invention are honeycomb-type articles or honeycombs which may be used for numerous applications including filters, catalyst supports, and heaters.

The need for uniform dispersion in deformable mixtures has long been recognized in the art, particularly in the formation of complex articles. Non-uniform dispersion leads to variability within the mixture which can lead to process variability as well as inconsistencies in final product characteristics. Non-uniform dispersion is often caused by the use of immiscible solvents or components in the mixtures which leads to the formation of localized areas of plastic and non-plastic mixtures during the mixing process. This lack of uniformity often leads to other problems and difficulties both in the forming of such mixtures and in the quality of the formed articles or structures. It is generally known that processing of non-uniformly dispersed mixtures consumes considerable power and require high extrusion pressure. Extrudates of such mixtures tend to be dry and non-cohesive. The extrudates tend to exhibit localized wet areas which may lead to uneven drying and distortions or collapse of the formed articles. Finally, such mixtures tend to damage the mixing equipment, particularly the mixing contact mechanisms as well as the drive motors of such equipment.

U.S. Pat. No. 4,992,233 issued to Swaroop et al. describes the formation of monolithic metal honeycombs from a mixture or batch including metal particles, an organic binder or binding agent, water, and a long chain aliphatic acid useful as a wetting agent, and a metal soap useful as a lubricant. Generally, long chain aliphatic acids are immiscible in polar liquids such as water. As a result, the mixture is non-uniformly dispersed and is subject to the problems discussed above.

There have been attempts made to solve the problems associated with differential shrinkage caused by uneven drying or liquid removal. Differential shrinkage leads to cracking, localized distortion, or collapse of the article, among other problems. U.S. Pat. No. 4,965,039 issued to Schuetz describes a method of making an inorganic slurry, forming the slurry into a flexible article, and rapidly removing the solvent medium from the article.

Problems, such as cracks, gas generation, fissures, bubbles and other aesthetic and structural defects in finished articles have also been noted in the ceramic forming industry. U.S. Pat. No. 4,996,015 issued to Yoshimoto et al. describes a method of forming ceramic honeycomb structures by the careful removal of a water/organic solvent system to avoid such structural and surface defects.

There is no teaching in these references of the use of water-miscible surfactants and/or solvents to provide a homogeneous, uniformly dispersed stable mixture free of bubbles or frothing. It is therefore the object of this invention to introduce into such mixtures a component which is compatible with polar liquids, to allow for uniform dispersion, and yield a homogeneous, bubble-free or stable plastically deformable mixture.

SUMMARY OF THE INVENTION

The object of this invention is to provide a plastically deformable mixture that is stable, froth-free, homogeneous and uniformly dispersed. It is also the object of the invention to produce useful formed articles having high skin quality, integrity and desirable processing characteristics. Skin quality is determined by the degree of smoothness of the skin and by the absence of streaks, cracks, bubbles, tears, holes or void cells. The integrity of the formed articles are also determined by the degree of plasticity of the articles. To provide such useful articles, it is contemplated within the scope of this invention to provide a mixture comprising finely divided metallic particulate matter, organic binding agent, polar liquid, anionic dispersing agent and nonionic surfactant. In a particularly useful embodiment, the mixture further comprises water-miscible organic solvent.

In one embodiment, the finely divided metallic particulate matter or metal powder is selected from aluminum, transition metals and combinations of these metals. In a preferred embodiment, the metallic particulate matter comprises aluminum and transition metal in the proportions of 5–95% and 95–5% respectively.

It is also an object of the invention to provide a mixture in which the organic binding agent comprises a polysaccharide, preferably cellulose ether, cellulose ester or combinations thereof. In one embodiment, the organic binding agent comprises a combination of at least two cellulose ethers both having between about 23 and 35 percent methoxyl substitutions and wherein at least one of the cellulose ethers has some hydroxypropyl substitution, preferably in the range of about 16 to 32 percent. In still another embodiment, the ratio of non-hydroxypropyl substitution to hydroxypropyl substitution is in the range of about 3:1 to 1:1. In one particularly useful embodiment, the ratio of non-hydroxypropyl substitution to hydroxypropyl substitution is about 2:1.

It is further the object of this invention to provide a plastically deformable mixture having substantially no gas generation, bubbling or frothing. To provide such a mixture, it is contemplated by this invention to provide a mixture further comprising water-miscible organic solvents. In a preferred embodiment, the water-miscible organic solvent comprises glycol ether having a terminal aliphatic function of at least three carbons and/or at least two ether groups each having at least two carbons.

It is also an object of the invention to describe the process of making the mixtures and forming shaped articles using the mixtures. In a preferred embodiment, the mixture of the invention is formed into a honeycomb shaped article which may be adapted for numerous uses for example, as a catalytic converter substrate or particulate filter in exhaust streams of internal combustion engines.

DETAILED DESCRIPTION OF THE INVENTION

The product of this invention is formed by combining finely divided metallic particulate matter, organic binding agent, polar liquid, anionic dispersing agent and nonionic surfactant. This invention also provides a mixture further comprising water-miscible organic solvent, to form a stable, homogeneous, uniformly dispersed, and froth-free plastically deformable mixture. Background art has not taught the use of water-miscible surfactants, dispersants or organic solvents to provide stable, homogeneous, uniformly dispersed mixtures free of bubbles or frothing.

Various metal powders may be used for the mixtures of the invention. Specifically, metallic particulate matter of varying grades and particle sizes may be used for this invention. Generally, fine metal particles are preferred, however, as more fully described below, mixtures containing high levels of fine particles are prone to frothing and gas generation. Finely divided metallic particulate matter or metal powder have been found to be particularly useful. Metals of particular interest for the invention comprise aluminum, transition metals and combinations thereof. Preferred transition metal include iron, nickel, chromium, zinc, or combinations thereof. In a preferred embodiment, the finely divided metal is a combination of aluminum and transition metal. In this embodiment, the proportions of transition metal and aluminum are 5–95% and 95–5% respectively. In one embodiment comprising a combination of aluminum and transition metal, iron powder having an average particle size of not greater than 6 microns was found to be particularly useful.

Use of an organic binder allows a wide range of plasticization and development of controlled material rheology. Typically, up to 10% (weight percent based on the total weight of metal in the mixture), of organic binder can used, preferably less than 5%. In a preferred embodiment, about 3.4% of organic binder is used.

Useful organic binders are the class of cellulose derived binders. In a particularly useful embodiment, the cellulose derived binder is polysaccharide. A particularly useful polysaccharide is one with molecules that generally consist of beta bonds between the sugar monomers therein. Notable binders of this category are cellulose ether, cellulose ester and combinations thereof. An example of a useful binder of this class is methyl cellulose.

In a particularly useful embodiment, the mixture comprises a combination of two cellulose ethers each having between about 23 and 35 percent, preferably 27 to 32 percent, methoxyl substitutions and at least one of the cellulose ethers having some hydroxypropyl substitution, preferably 16 to 32 percent substitution, most preferably, 27 to 30 percent. Articles formed of mixtures containing cellulose derived binders having methoxyl substitution and at least some degree of hydroxypropyl substitution tend to be relatively fast setting and exhibit generally good skin quality. In addition, they exhibit moderately rapid and complete drying when they are heated. It is believed that these tendencies are probably derived from the moisture retention nature of these organic binders.

The organic binder also serves as the plasticizer as well as the main rheological conditioner of the mixture. Useful organic binding agents which may be used in the practice of the invention include the class of cellulose derived binders such as methyl cellulose, for example, Methocel® A4M or A4C (supplied by Dow Chemical Company). The drawback of these unsubstituted methyl cellulose compounds is that articles formed with methyl cellulose-containing mixtures tend to have rough skin quality and are relatively stiff and brittle. In addition, mixtures containing these products also tend to require relatively high extrusion pressures. Also, such mixtures require variable processing conditions due to their increased sensitivity to seasonal changes.

In contrast, methyl cellulose binders having at least some hydroxypropyl substitution, such as Methocel® F4M, E4M, and K4M (all available from Dow Chemical Company), tend to produce mixtures which are softer, tend to yield smoother skin, require lower extrusion pressures, are relatively insensitive to seasonal changes and exhibit good green strength. However, products having these binders in their initial mixtures do not set-up or rigidify quickly and are difficult to dry.

It has been discovered that by combining these two different cellulose ether binders (i.e., substituted and non-substituted cellulose ethers) a synergistic effect is observed yielding a product having smooth skin, good green strength, lowered extrusion pressure, insensitivity to seasonal changes, and rapid setting or firming characteristics. Good results were obtained using a combination in which non-hydroxypropyl substituted methyl cellulose is proportioned with hydroxypropyl substituted methyl cellulose in a ratio in the range of about 3:1 to 1:1, preferably 2:1.

The surfactants of the invention generally comprise organic molecules with both hydrophobic and hydrophilic functionalities to allow full wetting of the metal particles by the dispersion medium. The surface activity of nonionic surfactants is determined by the Hydrophile-Lipophile Balance (HLB) values of the surfactants. HLB values are calculated by dividing the weight percent of ethylene oxide in the surfactant molecule by 5. The scale of measurement ranges from 0, being completely lipophilic or hydrophobic, to 20, meaning completely hydrophilic or lipophobic. For the mixtures of the invention, surfactants having HLB values of at least 10 are preferred, more preferably, at least 13. In a preferred embodiment, Triton® X-100, an alkylphenyl polyether alcohol having a HLB value of 13.5 (supplied by Rohm & Haas), was used as the nonionic surfactant. Normally, less than 5% surfactant is used, preferably, less than 1%. In a preferred embodiment, 0.5% nonionic surfactant is used.

The dispersing agent preferably comprises organic molecules having at least an anchoring group and a dispersing functionality to aid in dispersion of the powders. Salts of polymeric carboxylic acids were also found to be useful anionic dispersing agents or additives. Sodium salts of such acids are particularly useful in the practice of this invention. It is believed that ammonium salts of these acids are also practical and it is expected that such salts will be particularly useful during the binder removal or burnout process as they will burnout more thoroughly yielding a "cleaner" final product. A particularly useful dispersing agent for this invention is Tamol® 731, a proprietary water soluble sodium salt of a polymeric carboxylic acid, supplied by Rohm & Haas. Here again, it is normal to use less than 5% dispersing agent, preferably, less than 1%. In a particularly useful embodiment, 0.5% anionic dispersing agent is used.

The surfactant and the dispersing agent, when combined and mixed with finely divided metal particles, a polar liquid, and an organic binder, provide the well dispersed mixture of this invention which may be formed into useful articles or structures. Such mixtures tend to be well dispersed, with good microstructure and exhibit uniform drying characteristics. In a particularly useful embodiment, excellent results were obtained by adding 0.5% Triton X-100 and 0.5% Tamol 731 to the mixture. The resulting mixture of this embodiment was uniformly dispersed and exhibited good processing characteristics. In addition, the formed articles exhibited good skin quality.

In a particularly useful embodiment, the polysaccharide discussed above is combined with a water-miscible organic solvent to produce a mixture having controlled and desirable rheological properties, good drying characteristics, and reduced gas generation. As shown in Examples 16 to 24, by using certain combinations of these components, gas generation can be substantially eliminated.

Articles formed under conditions of excessive gas generation or frothing tend to exhibit poor skin quality having numerous holes or indentations. Excessive gas generation also leads to brittle extrudates which may crumble as they exit a forming device. It is believed that the metal particles react with the water or moisture in the mixture to form gas. Consequently, mixtures containing high levels of fine metal particles are more prone to gas formation and bubbling. It is believed that by protecting the active sites of the metal particles, reaction can be reduced thereby limiting gas generation and frothing. Acidic agents including citric acid, maleic acid, phosphoric acid and the like, have been found to be effective in suppressing gas formation in mixtures of fine iron powder and water. However. these agents also tend to react with the iron to form rust. Sodium metasilicate has been found to protect the iron powder from rusting, however, this alkali compound tends to react with the water to cause frothing and gas generation.

It has been discovered that additives which are insensitive to pH changes can be effectively used to protect the active sites of metal powders. One useful class of additives for this purpose is organic solvents. By adding organic solvents to the mixtures of this invention, gas generation is suppressed even in mixtures having very high levels of fine metal particles. Some of these advantages are shown in Examples 16 through 24. Particularly useful organic solvents are the water-miscible or soluble organic solvents such as for example, a glycol ether In one embodiment, the organic solvent is generally bifunctional. In a preferred embodiment, the organic solvent is a glycol ether which has a terminal aliphatic function of at least three carbons and/or has at least two ether groups of at least two carbons each. Bifunctional organic solvents such as glycol ether are believed to have at least a hydrophilic or lipophobic function and a hydrophobic or lipophilic function attached to the same molecule. It is believed that the hydrophobic end of the molecule will be readily adsorbed or anchored onto active metal sites on the individual metal powder particles and impart a water-repelling action in that area. It is also believed that the hydrophilic end will tend to make the entire molecule generally water compatible, thereby allowing dispersion of the metal particles with the anchored molecules in a polar liquid, particularly water. Particularly useful water-miscible organic solvents for this invention include butoxy triglycol, diethylene glycol monobutyl ether, 1-butoxy ethoxy-2-propanol and combinations of these solvents. Normally, 1.2 to 2.0%, preferably 1.3 to 1.8% of water-miscible organic solvents are used. In a preferred embodiment, about 1.4% of organic solvent is added to the mixture.

In a preferred embodiment, butoxy triglycol, a water-miscible organic solvent was added to the mixture. In this embodiment, the finely divided metal material appears to be protected from oxidation by the polar liquid (water) of the mixture, and gas generation which may occur in these mixtures was suppressed. The water-miscible solvent advantageously can comprise glycol ether. Especially suitable glycol ether is characterized by: (1) having a terminal aliphatic function of at least three carbons, and/or (2) having at least two ether groups of at least two carbons each. Other useful glycol ethers, besides butoxy triglycol, are diethylene glycol monobutyl ether, 1-butoxy ethoxy-2-propanol, or combinations of two or more of these glycol ethers.

The mixture of this invention can be formed into useful articles of various shapes and sizes by various known forming methods, for example, extrusion. Extrusion dies and methods of extruding mixtures are well known in the art. In one embodiment, the mixture is formed into thin-walled honeycomb structures by delivering the mixture longitudinally through feed passages to a plurality of interconnected discharge slots forming a gridwork, impeding the flow through such slots and laterally flowing a portion of the material delivered to such slots to form a unitary grid-like mass, and then discharging the mass to form a honeycomb structure as more fully described in U.S. Pat. No. 3,790,654. In a preferred embodiment, the mixture of this invention is formed into high cell density ceramic honeycomb structures using the extrusion dies and methods described in U.S. Pat. No. 4,902,216 incorporated herein by reference.

Any polar liquid may be used for the mixture of the invention. A particularly useful polar liquid is water, preferably in the range of 9 to 15%, most preferably in the range of 10 to 12%.

The tests described below were developed for the purpose of evaluating the mixtures of the invention. Unless otherwise specified, the mixtures were evaluated and tested as described in these tests.

Bag Test: involves combining the components of the deformable mixture in the desired amounts and mixing the components for two minutes at 40 RPM at room temperature in a Brabender torque rheometer (by C. W. Brabender Plasticorder, Inc.). After two minutes of mixing, a sample of the plastically deformable mixture is placed in an approximately 250 ml (one quart) capacity resealable plastic bag (such as a Ziploc bag). As much air as possible is excluded by hand squeezing the bag, after which the bag is sealed and allowed to stand for a period of time and observed. Inflation of the bag and/or discoloration of the mixture indicates gas generation and/or reaction within the mixture. Conversely, lack of discoloration and lack of inflation of the bag indicated that gas generation and/or reactions were being suppressed.

Mixing Test: involves the mixing of components in a torque rheometer (such as the Brabender torque rheometer described above) and mixing at 40 RPM at room temperature for twenty minutes. Mixing time is measured from the time the torque rheometer reaches its maximum torque. The final torque is the torque of the mixture after twenty minutes of mixing. A low final torque is an indication of relatively easy mixing and therefore good wetting and dispersion, while a high final torque indicates poor.

Forming Test: involves forcing the plastically deformable metallic mixture which is being evaluated through a forming member, such as an extrusion die. Unless otherwise specified, where forming tests were carried out by extrusion, they were done by extruding the mixtures first to form spaghetti-like strands of compacted and de-aired plastically deformable mixtures as more fully described in U.S. Pat. No. 4,551,295 incorporated herein by reference. The final forming for evaluation purposes was effected by extrusion through a honeycomb-forming die. Laboratory scale mixtures were extruded through a honeycomb forming die with a forming diameter of about 2.5 cm (1 inch) in diameter with about 64 cells/cm$^2$ (400 cells/in$^2$) using a small laboratory-sized ram-type extruder. Larger scale mixtures, of about 22.7 kg (50 lbs) were extruded through production sized dies 10–15 cm (4–6 inches) in diameter with about 64 cells/cm$^2$ (400 cells/in$^2$) using a ram-type extruder. Both ram-type and honeycomb die extruders are well known in the art.

Evaluation of formed articles: The resulting formed articles were examined for defects relating to dispersion or mixing and the wet green strength was determined by cutting the cell walls and checking the roundness, and/or smearing of the transverse cross section. In addition, both the extrusion pressure and drying time were used to determine the quality of the various mixtures.

The following examples are set forth in order to further illustrate the invention but are not intended as limitations. Unless otherwise specified, the total amount of metal powder was designated as 100% of the inorganic solids weight, and the amount of all other components are given as weight percentages based on the total weight of metal powder in the mixture.

Examples 1 through 8 are directed at the synergistic effect of water-soluble dispersants and surfactants on mixing and extrusion quality.

EXAMPLE 1

A reference mixture was made using metal powder, methyl cellulose, and water in the proportions (based on total weight of metal powders) given below.

| Material | Grade | Supplier | Wt. % |
|---|---|---|---|
| Iron powder | MH 300 325 mesh (45 microns) | Hoeganaes | 37.8 |
| Iron powder (Carbonyl OM) | fine (≦6 microns) | BASF | 34.2 |
| Al/Fe (50/50) | 400 mesh (38 microns) | Shield Alloy | 28.0 |
| methylcellulose | K75 | Dow Chemical | 3 |
| water | — | — | 9 |

The components were mixed according to the mixing test, and after mixing, the resulting mixture was formed by extrusion as described in the forming test above. The torque at the end of mixing was 3,500 m-g and the extrusion pressure required was about 84 kg/cm$^2$ (1200 psi). The resulting article displayed a very poorly formed skin, numerous tears, and large cracks in the skin as well as numerous void cells.

EXAMPLE 2

In this further reference example, 0.5% oleic acid, a water-immiscible wetting agent, and 0.5% zinc stearate, a long chain metal soap lubricant were added to the mixture of Example 1, and the resulting mixture was extruded through the same die. The mixture displayed higher torque at the end of mixing, 3,700 m-g and required lower extrusion pressure, about 38.5 kg/cm$^2$ (550 psi), than Example 1. Articles formed from this mixture were of better quality than those of Example 1 however, numerous cracks were observed in the skin of the honeycomb extrudate indicating low plasticity. It is believed that the low plasticity of the formed article of Example 2 is the result of mixing incompatible or immiscible components (oleic acid and zinc stearate) in water.

EXAMPLE 3

In this reference example, about 0.5% Tamol 731, a water soluble sodium salt of a polymeric carboxylic acid (supplied by Rohm & Haas), was added to the mixture of Example 1 to serve as an anionic dispersant. The mixture demonstrated good plasticity, with a final mixing torque of 3050 m-g, and formed into a honeycomb extrudate. The extrusion required higher pressure, about 52.5 kg/cm$^2$ (750 psi), and faster drying rate than the mixture of Example 2. The extrudate exhibited good skin quality and well formed cell walls however, the formed articles slumped and collapsed as it exited the extrusion die due to excessive plasticity.

In the next set of experiments, the effect of anionic dispersants in different metal compositions was examined.

EXAMPLE 4

A reference or control mixture was made including metal powder, methyl cellulose, oleic acid, zinc stearate and water in the following proportions:

| Material | Grade | Supplier | Wt. % |
|---|---|---|---|
| Iron powder | MH 300 325 mesh (45 microns) | Hoeganaes | ~71.3 |
| Al/Fe (50/50) | 400 mesh (38 microns) | Shield Alloy | ~27.7 |
| Zinc | chemical | unknown | ~0.99 |
| methylcellulose | K75 | Dow Chemical Co. | 6 |
| oleic acid | chemical | Mallinckrodt | 1 |
| zinc stearate | chemical | Fisher Scientific | 0.5 |
| water | | | 15 |

The metal composition of the mixture was formulated to approximate a typical alloy of 86/14/1 Fe/Al/Zn. After mixing, with a final torque of 5150 m-g, the resulting mixture was formed into a honeycomb which required a pressure of about 31.5 kg/cm$^2$ (450 psi). Upon extrusion clear streaks of longitudinal cracks and some collapsed cells were noted.

EXAMPLE 5

In this reference example, zinc stearate was eliminated from the mixture of Example 4 and the oleic acid was replaced with Tamol 731, a soluble anionic dispersing agent. The metal powder mixture of Example 4 was mixed with the following:

| | | | |
|---|---|---|---|
| methylcellulose | K75 | Dow Chemical Co. | 6 |
| dispersant | Tamol 731 | Rohm & Haas | 0.5 |
| water | | | 15 |

After mixing with a final torque of 3,400 m-g, the resulting mixture was formed into a honeycomb structure by extrusion requiring an extrusion pressure of about 42 kg/cm$^2$ (600 psi). The skin and cell qualities were significantly higher than those observed in Example 4.

EXAMPLE 6

In this further reference example, 0.5% Triton X-100, an alkylphenyl polyether alcohol (a nonionic water soluble surfactant supplied by Rohm & Haas), was added to the mixture of Example 1. The final mixing torque was significantly reduced to 2850 m-g demonstrating that use of the surfactant enhances ease of mixing and homogeneity of the mixture, and possibly, a well dispersed mixture. However, during the forming stage, significant froth was observed. It is believed that the froth was due to gas generation caused by the reaction of the nonionic surfactant with the metal particles. Extrusion of this mixture required an extrusion pressure of about 77 kg/cm$^2$ (1100 psi), and yielded a poorly formed article.

EXAMPLE 7

In this example of the invention, 0.5% of a nonionic surfactant was added to the mixture of Example 3. This combination of anionic dispersant and nonionic surfactant led to a synergistic effect whereby the resulting mixture exhibited an acceptably low final mixing torque of 3150 m-g and an extrusion pressure of about 47 kg/cm$^2$ (675 psi). The rate of drying was significantly increased and the plasticity of the mixture was good. The formed article exhibited good skin quality with no bubbles, holes or indentations.

EXAMPLE 8

In this further example of the invention, the slumping problem observed in Example 3 was reduced by increasing the solids loading. This was done by reducing the water content of the mixture of Example 1, from 9% to 8%, and adding 0.5% Tamol 731, and 0.5% Triton X-100. The resulting mixture was observed to exhibit reasonable plasticity. The extrudate, formed at a pressure of about 100 kg/cm$^2$ (1,425 psi), exhibited good skin quality and well formed cell walls which were self-supporting. The final mixing torque cannot be reported due to a recorder failure during this test, however, it is estimated that the mixture had a final mixing torque higher than 3150 m-g.

Examples 9 through 15 are directed at the synergistic effect of combining different binding agents in a plastically deformable mixture. These examples demonstrate that by combining different polysaccharides, specifically, cellulosic binders, plastically deformable mixtures are produced which are easy to extrude, exhibit rapid setting properties, and yield formed structures having good skin quality and integrity.

EXAMPLE 9

In this example of the invention, two different cellulose ethers were combined in the mixture in the proportions given below:

| Material | Grade | Supplier | Wt. % |
|---|---|---|---|
| Iron powder (Carbonyl OM) | fine (≦6 microns) | BASF | 54 |
| Al/Fe (50/50) | 400 mesh (38 microns) | Shield Alloy | 46 |
| methylcellulose | A4C | Dow Chemical | 2.3 |
| hydroxypropyl methylcellulose | F4M | Dow Chemical | 1.1 |
| Tamol-731 | — | Rohm & Haas | 0.5 |
| Triton X100 | — | Rohm & Haas | 0.5 |
| water | — | — | 11 |

The resulting mixture was formed by extruding through a die intended to form honeycombs of about 64 cells/cm$^2$ (400 cells/in$^2$) with approximately 0.15 mm (0.006 inches) thick walls. The extrudate was passed between two 250 watt infrared lamps situated about four inches below the exit face of the forming member and spaced about four inches apart. The formed articles were heated for about twenty seconds, separated transversely near the die face, placed in horizontal position overnight and then cut through the previously heated portion for observation.

The mixture required an extrusion pressure of about 40 kg/cm$^2$ (575 psi), displayed tough green strength and was neither too brittle nor too soft. The formed articles had good skin quality. Examination of its round cross section suggested rapid setting which was noticeable after only twenty seconds of heating. After this period of heating, no sagging or ovoid cross section was noted. The fast setting character was also determined by the lack of saw-cut smear.

EXAMPLE 10

In reference example, in order to determine the relative quantitative limits of the binder combinations, the amount of A4C in the mixture of Example 9 was increased from 2.3 wt. % to 3.4 wt %. The mixture required an extrusion pressure of about 47 kg/cm$^2$ (675 psi), and displayed rapid stiffening and brittle quality. The formed article of this mixture exhibited poor, rugged skin quality. The rapid setting character was determined by the round cross section and lack of saw-cut smear.

EXAMPLE 11

In this reference example, the A4C component of Example 9 was replaced with F4M in the same proportion. The formed article demonstrated an oval shaped and smeared cut transverse cross section, indicating lack of set and poor drying. The skin of the formed article was of fair quality and the mixture was sufficiently soft to be extruded at about 42 kg/cm$^2$ (600 psi).

EXAMPLE 12

In this further reference example, the proportion of A4C and F4M in Example 9 was changed to a ratio of 1:1. The formed article displayed a rough skin and an oval and smeared cross section indicating a low setting rate.

EXAMPLE 13

In another reference example, the Tamol 731 and Triton X-100 additives of Example 9 were replaced with 1% oleic acid. The mixture required an extrusion pressure of about 35 kg/cm$^2$ (500 psi), and the formed article exhibited a fast set rate and smooth skin. However, the quality of the skin was not as high as was observed in Example 9 in which the water compatible additive system was employed. On transverse cutting of the extrudate, severe smearing was noted indicating poor drying. It is believed that the generally poor drying is as a result of the relatively high boiling point and water-immiscibility of the oleic acid.

EXAMPLE 14

To determine the effect of polymer chain length of the gelable binder on both the mixture rheology and the final product, in this example of the invention, A4M Methocel® (supplied by Dow Chemical), was substituted for the A4C Methocel® of Example 9 in the same amount. It is well known that the average polymer chain length or molecular weight of a polymer can be determined by its viscosity. The viscosity of a water solution containing 2 wt. % of A4C at 25° C. was determined to be about 400 centipoise (cps). Under the same conditions, a similar solution of A4M was determined to have a viscosity of about 4,000 cps. This mixture, containing A4M exhibited good skin quality and required an extrusion pressure of about 49 kg/cm$^2$ (700 psi). The mixture also demonstrated acceptably fast setting characteristics.

EXAMPLE 15

In this reference example, both the A4C and F4M components of Example 9 were replaced with 3.4% A4M. The rheology of this mixture was poor and the resulting extrudate exhibited very brittle and rugged skin which contained numerous holes.

Gas generation in deformable mixtures results from the reaction of active sites of the metal particles with water or moisture in these mixtures. Fine metal particles tend to produce articles having good skin quality, however, these fine particles are also most likely to result in gas generation because they provide numerous active sites. The following set of examples explore the effect of water-miscible organic solvents on gas generation in plastically deformable mixtures.

EXAMPLE 16

In this control example, aluminum alloy powders were stirred into a 9:1 water:solvent mixture and examined for gas generation. The test was repeated using different organic solvents. In all cases, gas formation appeared to be suppressed however, butoxy triglycol appeared to yield the best result.

EXAMPLE 17

A complete reference mixture including metallic particulate matter, anionic dispersant or dispersing agent, nonionic surfactant, gelable organic binding agent or binder, and polar liquid (in this case water), but without water-miscible organic solvent (using the same components and in the same proportions as was used in Example 9 above) was made and mixed for two minutes in the Brabender torque rheometer. After mixing, the bag test was run on the resulting mixture. This control mixture without any water-miscible organic solvent exhibited a well inflated bag after four hours.

EXAMPLE 18

In this example of the invention, 1.5% 1-butoxy ethoxy-2-propanol was added to the mixture of Example 17. Applying the bag test, no noticeable inflation was observed until after one week.

EXAMPLE 19

In this further example of the inventions, the 1-butoxy ethoxy-2-propanol was replaced with 1.5% butoxy triglycol. When applied to this mixture, the bag test yielded a bag with no noticeable inflation after more than five weeks.

EXAMPLE 20

In a similar test of an example of the invention, the butoxy triglycol of Example 19 was replaced with 1.5% diethylene glycol monobutyl ether. The bag test yielded a bag with little inflation after more than five weeks.

EXAMPLE 21

This example of the invention was performed in order to test the effectiveness of organic solvents on large scale production quantity batches. A batch containing approximately 23 kg (50 lbs.) of mixture was prepared in the following amounts:

| Material | Grade | Supplier | Wt. % |
|---|---|---|---|
| Iron powder Carbonyl OM | Fine (≦6 microns) | Hoeganaes | 54.0 |
| Al/Fe (50/50) | 400 mesh (38 microns) | Shield Alloy | 46.0 |
| Anionic dispersant | Tamol 731 | Rohm & Haas | 0.5 |
| Nonionic surfactant | Triton X-100 | Rohm & Haas | 0.5 |
| methylcellulose | A4C | Dow Chemical | 2.3 |
| hydroxypropyl methylcellulose | F4M | Dow Chemical | 1.1 |
| Organic solvent | butoxy triglycol | Union Carbide | 1.4 |
| water | | | 12.6 |

After thorough mixing, this mixture was allowed to stand for two hours after which the mixture was formed by extrusion through a die designed to produce thin wall cellular honeycombs with about 88 cells/cm$^2$ (550 cells/in$^2$) and having about 0.076 mm (0.003 inch) thick walls. The extrudate of this experiment was of good quality and did not crumble or collapse, or exhibit any defects to indicate gas generation or entrainment during the shaping process. The extruded mixture was soft and tended to collapse when formed into very thin wall cellular honeycombs. It is expected that this mixture will be useful for certain application, for example, for the production of thicker wall honeycomb structures with wall thickness of about 0.18 mm (0.007 in.) for example.

EXAMPLE 22

In this reference example, the amount of organic solvent in Example 21 was reduced from 1.4 to 1.2% and the water content was reduced from 12.6 to 11.2%. Gas generation was noted after about 1.5 hours of extrusion.

EXAMPLE 23

In this example of the invention, the amount of organic solvent in Example 21 was increased to 2% and the water content was reduced to 11.5%. The resulting mixture yielded good quality extrudates with little or no gas generation.

EXAMPLE 24

In this further example of the invention, the amount of water in the mixture of Example 23 was reduced from 11.5% to 9.5%. The result was a mixture having a significantly high metal loading of 53.9% by volume and no gas generation. The formed articles of this mixture were well-formed, easily dried, and exhibited no bubbles or holes.

Having fully disclosed the preferred embodiment of the invention, it will be apparent to those skilled in the art that various changes and modifications may be made without departing from the broad spirit and scope of the invention as defined in the appended claims.

What is claimed is:

1. A plastically deformable mixture which comprises finely divided metal powder, 1.2–2% water-miscible organic solvent, 3–10% organic binding agent consisting of polysaccharide, 9–15% water, 0.5–5% anionic dispersing agent, and 0.5–5% nonionic surfactant.

2. The mixture of claim 1, wherein the nonionic surfactant is a polyether alcohol.

3. The mixture of claim 1, wherein the nonionic surfactant has a calculated HLB value of at least 10.

4. The mixture of claim, 3, wherein the nonionic surfactant is an alkylphenyl polyether alcohol.

5. The mixture of claim 1, wherein the anionic dispersing agent is a salt of a polymeric carboxylic acid.

6. The mixture of claim 5, wherein the salt is a sodium salt of a polymeric carboxylic acid.

7. The mixture of claim 5, wherein the salt is an ammonium salt of a polymeric carboxylic acid.

8. The mixture of claim 1, which comprises a salt of a polymeric carboxylic acid and an alkylphenyl polyether alcohol.

9. The mixture of claim 1, wherein the polysaccharide molecules generally consist of beta bonds between the sugar monomers therein.

10. The mixture of claim 9, wherein the polysaccharide is selected from the group consisting of cellulose ether, cellulose ester, and combinations thereof.

11. The mixture of claim 10, wherein the polysaccharide comprises a combination of at least two cellulose ethers both having between about 23 and 35 percent methoxyl substitutions and wherein at least one cellulose ether has some hydroxypropyl substitution.

12. The mixture of claim 11, wherein the cellulose ethers have methoxyl substitution in the range of about 27 to 32 percent and wherein the hydroxypropyl substitution is present in the range of about 16 to 32 percent.

13. The mixture of claim 12, wherein the hydroxypropyl substitution is in the range of about 27 to 30 percent.

14. The mixture of claim 11, wherein the ratio of non-hydroxypropyl substitution to hydroxypropyl substitution is in the range of about 3:1 to 1:1.

15. The mixture of claim 14, wherein the ratio of non-hydroxypropyl substitution to hydroxypropyl substitution is about 2:1

16. The mixture of claim 1, wherein the finely divided metal comprises aluminum.

17. The mixture of claim 1, wherein the finely divided metal comprises transition metal.

18. The mixture of claim 17, wherein the transition metal comprises iron, nickel, chromium, zinc, or combinations thereof.

19. The mixture of claim 1, wherein the finely divided metallic particulate matter comprises transition metal and aluminum.

20. The mixture of claim 19, wherein the proportions of transition metal and aluminum in the finely divided particulate matter are 5–95% and 95–5% respectively.

21. The mixture of claim 1, wherein the water-miscible organic solvent is glycol ether.

22. The mixture of claim 21, wherein the glycol ether has a terminal aliphatic function of at least three carbons.

23. The mixture of claim 22, wherein the glycol ether further comprises at least two ether groups of at least two carbons each.

24. The mixture of claim 23, wherein the glycol ether is butoxy triglycol.

25. The mixture of claim 21, wherein the glycol ether has at least two ether groups each having at least two carbons.

26. The mixture of claim 21, wherein the glycol ether is selected from the group consisting of butoxy triglycol, diethylene glycol monobutyl ether, 1-butoxy ethoxy-2-propanol, and combinations thereof.

27. A plastically deformable mixture comprising:

transition metal and aluminum in the proportions of 5–95% and 95–5% respectively;

polysaccharide comprising a combination of at least two cellulose ethers both having between about 27 and 32% methoxyl substitutions and at least one cellulose ether having 27 to 30% hydroxypropyl substitution, and wherein the ratio of non-hydroxypropyl substitution to hydroxypropyl substitution is in the range of about 2:1;

salt of a polymeric carboxylic acid;

alkylphenyl polyether alcohol having a calculated HLB value of at least 13;

glycol ether selected from the group consisting of butoxy triglycol, diethylene glycol monobutyl ether, 1-butoxy ethoxy-2-propanol, and combinations thereof, wherein the glycol ether has at least two ether groups each having at least two carbons; and water.

* * * * *